US005216442A

United States Patent [19]

Parks et al.

[11] Patent Number: 5,216,442

[45] Date of Patent: Jun. 1, 1993

[54] MOVING PLATEN ARCHITECTURE FOR AN INK JET PRINTER

[75] Inventors: Bruce J. Parks; William R. Burger, both of Fairport; Edward C. Hanzlik, Webster, all of N.Y.; John Fox, Old Town, England

[73] Assignee: Xerox Corporation, Stamford, Conn.

[21] Appl. No.: 791,687

[22] Filed: Nov. 14, 1991

[51] Int. Cl.[5] ..... B41J 2/01; B41J 2/165; B41J 11/06

[52] U.S. Cl. ..... 346/134; 346/140 R; 400/648; 400/649

[58] Field of Search ..... 346/140 R, 134; 400/648, 649, 656; 101/35, 41, 44; 355/234

[56] References Cited

U.S. PATENT DOCUMENTS

| | | | |
|---|---|---|---|
| 3,737,233 | 6/1973 | Yamamoto | 355/8 |
| 3,754,822 | 8/1973 | Melrose | 355/8 |
| 4,207,578 | 6/1980 | Marinoff | 346/75 |
| 4,551,014 | 11/1985 | Nakatomi et al. | 355/234 X |
| 4,801,981 | 1/1989 | Chikano et al. | 346/134 X |
| 4,992,805 | 2/1991 | Yoshizawa et al. | 346/134 |
| 5,051,761 | 9/1991 | Fisher et al. | 346/140 R |
| 5,124,728 | 6/1992 | Denda | 346/134 |
| 5,135,317 | 8/1992 | Greenwood et al. | 101/35 X |

*Primary Examiner*—Benjamin R. Fuller
*Assistant Examiner*—Alrick Bobb
*Attorney, Agent, or Firm*—Oliff & Berridge

[57] ABSTRACT

An ink jet printer includes a platen having a planar surface sized to hold a sheet upon which an image is to be printed flat on the planar surface. The platen is movably mounted for linear reciprocal movement between a sheet receiving position and a sheet releasing position. In operation, a sheet is fed onto or otherwise acquired on the platen. The sheet can be held on the platen by a holddown force such as by vacuum or electrostatic attraction. The platen moves a sheet held thereon across a full width printhead located between the two positions to print an image on the sheet. Sheets are released from the platen at the sheet releasing position which may include an output tray. After the sheet is released from the platen, the platen is reciprocated back to the receiving position to accept another sheet. During periods when the platen is at either the sheet receiving position or at the sheet releasing position, a maintenance station located between the receiving position and the releasing position on a side of the platen opposite from the printhead may be used to perform maintenance on the printhead.

25 Claims, 4 Drawing Sheets

MOVING PLATEN ARCHITECTURE FOR AN INK JET PRINTER

BACKGROUND OF THE INVENTION

1. Field of the Invention

The present invention is directed to ink jet printers, and in particular to ink jet printers having a flat, movable platen for receiving a recording medium (e.g. a sheet of paper) which maintains the recording medium flat as it is conveyed past an ink jet printhead. The present invention is also directed to such printers having an architecture that provides easy access between the printhead and a printhead maintenance station.

2. Description of Related Art

Ink jet printers can generally be divided into two types: one type using thermal energy to produce a vapor bubble in an ink filled channel that expels a drop of ink; or another type using a piezoelectric transducer to produce a pressure pulse that expels a droplet from a nozzle.

Thermal ink jet printers use thermal energy selectively produced by resistors located in capillary-filled ink channels near channel terminating nozzles or orifices to vaporize momentarily the ink and form bubbles on demand. Each temporary bubble expels an ink droplet and propels it towards a recording medium. The printers can be incorporated in either a carriage-type printer or a pagewidth type printer. The carriage-type printer generally has a relatively small printhead containing the ink channels and nozzles. The printhead is usually sealingly attached to a disposable ink supply cartridge and the combined printhead and carriage assembly is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. For an example of a carriage-type printer, refer to U.S. Pat. No. 4,571,599 to Rezanka, the disclosure of which is incorporated herein by reference. In contrast, the pagewidth printer includes a stationary printhead having a length equal to or greater than the width of the paper. The paper is continuously moved past the pagewidth printhead in a direction normal to the printhead length and at a constant speed during the printing process. Refer to U.S. Pat. No. 4,463,359 to Ayata et al, the disclosure of which is incorporated herein by reference, for an example of a pagewidth printhead. Refer to U.S. Pat. No. 4,829,324 to Drake et al, the disclosure of which is incorporated herein by reference, for another example of a pagewidth printhead.

These thermal ink jet printheads are either of the side-shooter-type, having nozzles formed on a side of the printhead where two substrates are joined to each other, or of the roof-shooter-type having nozzles formed as apertures in an uppermost substrate (or "roof") of the printhead. The above-mentioned patents disclose side-shooter-type thermal ink jet printheads. For an example of a roof-shooter-type thermal ink jet printhead, see U.S. Pat. No. 4,789,425 to Drake et al, the disclosure of which is incorporated herein by reference.

Piezoelectric activated ink jet printing systems use a pulse generator which provides an electric signal. The signal is applied across crystal plates, one of which contracts and the other of which expands, thereby causing the plate assembly to deflect toward a pressure chamber. This causes a decrease in volume which imparts sufficient kinetic energy to the ink in the printhead nozzle so that one ink droplet is ejected into a recording medium. Refer to U.S. Pat. No. 4,144,537 to Kimura et al, the disclosure of which is incorporated herein by reference, for an example of a piezoelectric activated ink jet printer.

The present invention is applicable to printers employing thermal or piezoelectric activated printheads, as well as ink jet printheads relying on other types of ink droplet driving engines for controllably directing ink droplets onto a recording medium.

Conventional ink jet printers have an architecture wherein sheets are conveyed (either stepwise or continuously) past a printhead (either carriage-type or pagewidth) for having images printed thereon. The sheets are supported on a platen located closely adjacent to the printhead so as to maintain the sheet a precise distance spaced from the printhead nozzles. These platens either supply the motive force to the sheets to convey the sheets past the printhead, or merely act as a support. For example, the above-mentioned U.S. Pat. No. 4,463,359 to Ayata et al uses a cylindrical drum platen to convey a sheet past a printhead (see FIGS. 55–57). These cylindrical platens, however, can cause the sheets to curl, and can cause image distortion (or require nozzle-control compensation) since some of the printhead nozzles will be located further from the curved surface of the cylindrical platen than other nozzles.

U.S. Pat. No. Re. 32,572 to Hawkins et al discloses in FIG. 1, a printer architecture having a flat platen so that a sheet is everywhere equally spaced from the printhead nozzle. However, the platen does not move or convey the sheets past the printhead (a separate mechanism moves the sheets).

U.S. Pat. No. 4,207,578 to Marinoff discloses an ink jet printer where an endless belt conveys sheets past a printhead. The printhead can be arranged adjacent to a flat portion of the belt so as to maintain the sheet equally spaced from all nozzles of the printhead during printing.

These ink jet printheads usually require maintenance, for example, in order to: (1) clear clogged nozzles; (b) remove air from the printhead (air particularly interferes with droplet formation in thermal ink jet printheads); (c) clean dirt and excess ink from the nozzle-containing surface of the printhead; (d) cap the printhead nozzles during periods of non-use in order to prevent drying of ink in the nozzles; and (e) prime the printhead nozzles (individually, or all at once) at printer start-up, or even between sheets (inter-sheet purging).

Carriage-mounted printheads (where the printhead is relatively small and is mounted on a carriage that reciprocates across the width of a page) often include maintenance stations mounted at a side of the printing area, with the printhead being moved to the side of the printing area for having maintenance performed thereon. See, for example, U.S. Pat. No. 4,853,717 to Harmon et al. Since the printhead and platen must be located very close to each other, and it is not simple to provide an architecture where the platen and printhead are moved apart from each other so that a maintenance station can be moved therebetween, the location of the maintenance station alongside of the printing area has worked well with carriage-type printers.

However, in printers having pagewidth printheads, where the printhead extends entirely across a sheet, the printhead is stationarily mounted, and therefore the maintenance station can not be located to a side of the printing area. Pagewidth printheads can print much faster than carriage-type printheads, and therefore are preferred. However, thus far it has been difficult to integrate maintenance stations with existing pagewidth printhead architectures.

U.S. Pat. No. 5,051,761 to Fisher et al discloses a printer architecture wherein a maintenance station for a pagewidth ink jet printhead is located within an endless belt platen, or within a drum platen. The endless belt platen or drum platen includes a window through which the maintenance station is moved in order to engage the pagewidth printhead.

U.S. Pat. No. 4,207,578 to Marinoff discloses a carriage-type ink jet printhead having an endless-belt-type platen. As shown in FIGS. 3–4, the belt includes a slot which can be located across from the printhead for receiving ink and other materials expelled from the printhead during a flushing operation.

While both of these patents disclose architectures suitable for use with pagewidth printheads, any inter-sheet maintenance operations which might need to be performed (for example, cleaning and/or purging of some or all of the printhead nozzles) require the belt- or drum-type platens to be precisely located so that the window or slot is aligned with the printhead. Thus, even when the maintenance operation can be performed quickly, extra time may be required in order to precisely locate the platen slot relative to the printhead. Moreover, if such alignment is not precise, the platen may inadvertently receive ink, causing smudging of subsequent sheets.

U.S. Pat. No. 3,754,822 to Melrose discloses a scanning system for a copier which includes a moving transparent platen. A document to be copied is supported by the platen which is supported on a machine frame. The platen reciprocates across the frame past a scanner. An electrostatic plate is supported for movement along a plane parallel to the platen. The platen and the plate move to the right while the scanner moves to the left from an initial position to an end of scan position. The scanner and the platen then return to their respective initial positions while the plate continues to the right to a processing station. In another embodiment, shown in FIG. 4, a conveyor moves a paper sheet, to receive an image from the document from a supply tray past the scanner.

U.S. Pat. No. 3,737,223 to Yamamoto discloses an apparatus for driving a platen in an electrophotographic copying machine. The apparatus includes a platen, a drive roller in frictional contact with a bottom of the platen, a platen support means, a power means for driving the drive roller to move the platen along a horizontal plane, and depressing means for depressing the platen onto the drive roller to prevent vertical movement of the platen. The apparatus is used to convey an original document located on the platen from an initial position, past a scanner, and reciprocate the platen, including the original document, back to the initial position.

Although U.S. Pat. Nos. 3,754,822 and 3,737,223 disclose reciprocating platens, these platens are not used to convey blank sheets past a printing mechanism. Additionally, these patents do not suggest the use of reciprocating platens for conveying sheets past an ink jet printhead, or the advantages obtained thereby.

OBJECTS AND SUMMARY OF THE INVENTION

It is an object of the present invention to provide an ink jet printer having an architecture which maintains a sheet flat in the printing zone.

It is another object of the present invention to provide an ink jet printer having an architecture which enables good control of sheet motion in the printing zone.

It is another object of the present invention to provide an ink jet printer having an architecture which provides for easy access between a printhead maintenance station and the printhead, particularly when the printhead is a pagewidth printhead.

It is a further object of the present invention to provide an ink jet printer having a reduced number of paper path components, thus reducing the possibility of paper jams.

To achieve the foregoing and other objects, and to overcome the shortcomings discussed above, an ink jet printer architecture includes a flat, planar platen, sized to hold a sheet of recording medium, and mounted for linear reciprocal movement between a sheet receiving position and a sheet releasing position. A pagewidth ink jet printhead is mounted between the sheet receiving position and the sheet releasing position, so that as the platen moves a sheet between these positions, an image is printed by the printhead on the sheet. A maintenance station can be provided in opposition to the printhead, and on an opposite side of the movable platen from the printhead. When the platen is located at the sheet receiving position or at the sheet releasing position, the maintenance station can be used to perform one or more maintenance operations on the printhead. In a preferred embodiment, the maintenance station is movable into engagement with the printhead for performing maintenance operations thereon.

In operation, a sheet is fed onto and acquired on the platen. The sheet is held on the platen by, for example, a holddown force provided by a vacuum or by electrostatic attraction. The platen moves the sheet held thereon across the pagewidth printhead to print an image onto the sheet in a print zone. Sheets are released from the platen at the sheet releasing position which may include an output tray. After the sheet is released from the platen at the releasing position, the platen is reciprocated back to the receiving position to accept another sheet (this return motion is known as "fly-back"). During periods when the platen is at either position, the maintenance station may become engaged with the printhead to perform maintenance operations on some or all of the printhead nozzles.

The platen movement from the sheet receiving position to the sheet releasing position and back can be controlled by any appropriate control system. If the platen is controlled by a closed loop system which controls the printhead, the image driver could compensate for any detected platen motion variations by appropriately controlling the rate at which the video signal is supplied to the printhead. Alternatively, a closed loop feedback servo-motor system could be used to precisely monitor and control the movement of the platen. Standard sensors known in the art may be used to sense the position and/or velocity of the platen.

The sheets can be conveyed to and from the platen any number of ways. For example, sheets could be fed from a supply tray along a supply paper path to the platen, and then removed from the platen at the sheet releasing position, fed through a printed sheet paper path and deposited in a collection tray. This architecture permits sheets to be inverted and re-fed to the receiving position for two-sided printing if desired. Alternatively, when the printhead is arranged to expel ink droplets in the vertically upward direction, the platen (which would have its sheet-receiving surface facing downward) could remove sheets directly from a supply tray (or pallet) at the sheet receiving position, and release printed sheets directly onto a receiving tray at the sheet releasing position. This arrangement eliminates conventional paper paths, reducing the possibility of paper jams.

The present invention offers several advantages over existing ink jet printing systems which have primarily used drum or endless belt platen configurations. Easy access is provided between the prinhead assembly and the printhead maintenance station. The maintenance station, when the platen is at either the sheet releasing position or the sheet receiving position, can freely move to engage with the printhead to perform routine maintenance operations such as inter-sheet purging, priming, cleaning or capping of the printhead. The linearly reciprocating platen enables good control of motion quality through the print zone and maintains the sheet flat when in the print zone. The linear platen architecture also allows flexibility in adding additional components into the system, such a drying station which can be placed downstream of the printhead.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

Figure 1:
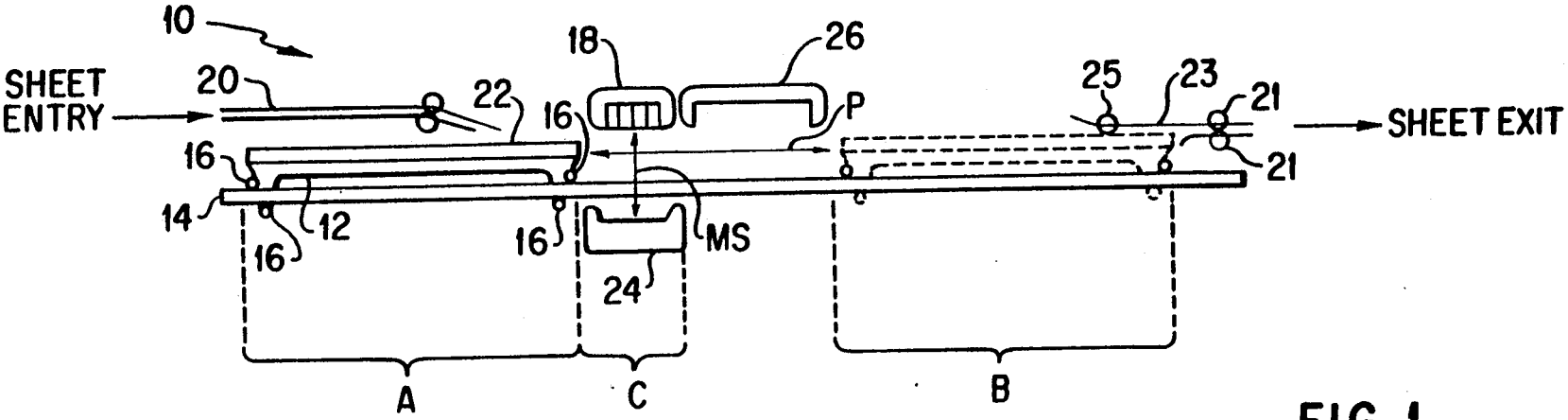
FIG. 1 is a side partial view of an ink jet printer according to one embodiment of the present invention.

With reference to FIG. 1, there is shown an ink jet printer 10 having a platen 12 which is linearly reciprocally movable along a plane P from a sheet receiving position A to a sheet releasing position B (the platen is shown with dashed line in the sheet releasing position). In the illustrated embodiment, platen 12 is supported for linear reciprocal movement by a pair of guide rods 14. Rollers 16 attached to platen 12 move along the guide rods 14 to allow movement of the platen along only plane P. A full width printhead 18 is located between the two positions A and B in a print zone C and at a side of plane P. In the FIG. 1 example, printhead 18 is located above plane P (which extends horizontally). However, as will be seen, the printhead can be located below a horizontal platen plane. Further, the platen plane could extend vertically, or at other angles, with the printhead being located on one side thereof. The illustrated printhead is a four-color pagewidth printhead having four linear arrays of nozzles (one array for reach color), each array extending across a width of a sheet of recording medium. Of course, single color pagewidth printheads, as well as carriage-type printheads could be used in the printer-architecture of the present invention. The printhead 18 is spaced from the platen plane P by an appropriate distance conventional in the art.

In operation, a sheet enters the system via a sheet input path 20 which supplies paper to the platen 12 from a paper supply or from a manual input slot. The sheet is supplied to, and acquired (aligned) on a planar sheet receiving surface 22 of the platen 12 and held thereon by a holddown force (if necessary) while the platen 12 is located at the sheet receiving position A. The holddown force may be provided by a vacuum acting through apertures in the planar sheet receiving surface 22. Alternatively, the holddown force may be provided by electrostatic attraction. Both methods for providing sheet holddown forces are well known in the art. Of course, other mechanisms, for holding a sheet flat on a surface can be substituted for, or used in addition to the vacuum and electrostatic mechanisms as deemed appropriate. For example, gripper bars, as disclosed in U.S. Pat. No. 4,986,526 to Richard M. Dastin, could also be used to hold a sheet on a platen.

Once a sheet is acquired onto the sheet receiving surface 22 of platen 12, the platen can be controlled to linearly travel along the guide rods 14 in plane P toward the sheet releasing position B, and through print zone C. As the platen 12 is linearly moved, it moves the sheet held thereon past the printhead 18 which prints an image onto the sheet. The platen 12 continues to linearly move the sheet (having an image thereon) along plane P until the platen 12 and sheet reach releasing position B. When the platen 12 has traveled fully into the sheet releasing position, the holddown force may be released and the sheet can be removed from platen 12 by, for example, a stripping roller 25, and fed along a sheet output path 23 which may include one or more roller pairs 21 for further processing or exiting to an output tray.

The ink jet printer 10 may further include a maintenance station 24 located on an opposite side of platen plane P from printhead 18 and generally in opposition to printhead 18. When platen 12 is not located in print zone C (i.e., is located at either the sheet receiving position A or the sheet releasing position B), the maintenance station 24 can be used to perform maintenance operations on printhead 18. For example, when performing an intersheet printhead purging operation (where ink is expelled through the printhead nozzles so as to clear ink therefrom-this is also frequently done at printer start-up), station 24 can remain at the position indicated in FIG. 1 spaced away from printhead 18. Although this function is similar to the function performed by the stationary trough in U.S. Pat. No. 4,207,578 (to Marinoff), the present invention offers advantages over the printer architecture of U.S. Pat. No. 4,207,578. For example, the present invention does not require alignment of a belt aperture with the printhead prior to performing the purging operation. In the present printer architecture, access between the printhead and a maintenance station naturally occurs whenever the platen is located at the sheet releasing position or at the sheet receiving position. Accordingly, with the present printer architecture, it is possible to perform an intersheet purging operation, possibly without interrupting the process of feeding sheets to or from platen 12.

It is also possible to use a maintenance station 24 which is free to move through plane P, along line MS, and into engagement with printhead 18 to perform maintenance operations such as, for example, purging, priming, capping, wiping, or the like on printhead 18. For example, the rotating maintenance station disclosed in the above-mentioned U.S. Pat. No. 5,051,761 to Fisher et al can be used as maintenance station 24. Accordingly, the disclosure of U.S. Pat. No. 5,051,761 is incorporated herein by reference. This rotating maintenance station includes a priming portion (vacuum application to the nozzles), a capping-spitting (purging) portion, a nozzle wiping blade portion, and a sliding single jet priming portion, all mounted on and spaced about the outer surface of a rotating support member. Each of the above referenced types of maintenance performing portions are generally known in the art, and thus will not be described in any more detail. For an example of a sliding single jet priming station, see U.S. patent application Ser. No. 07/777,043 to Almon P. Fisher et al entitled "Movable Ink Jet Priming Station", filed Oct. 16, 1991, the disclosure of which is incorporated herein by reference.

Figure 5:
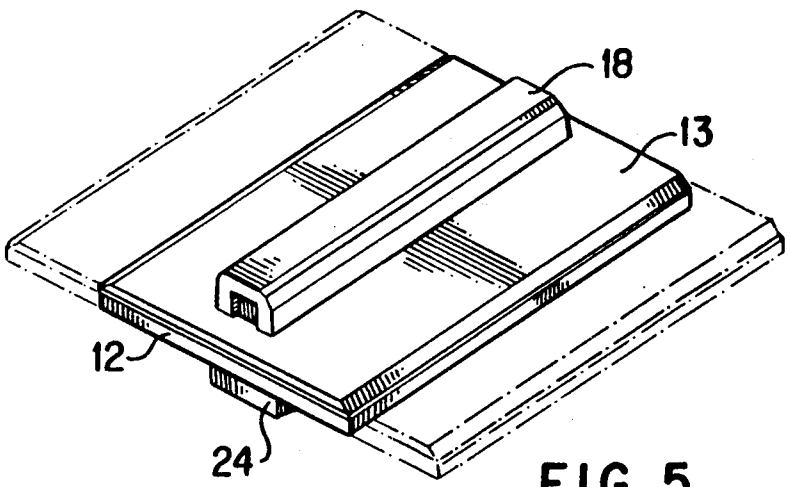
FIG. 5 is a perspective view of a printhead and maintenance station according to the present invention in a print position.
Figure 4:
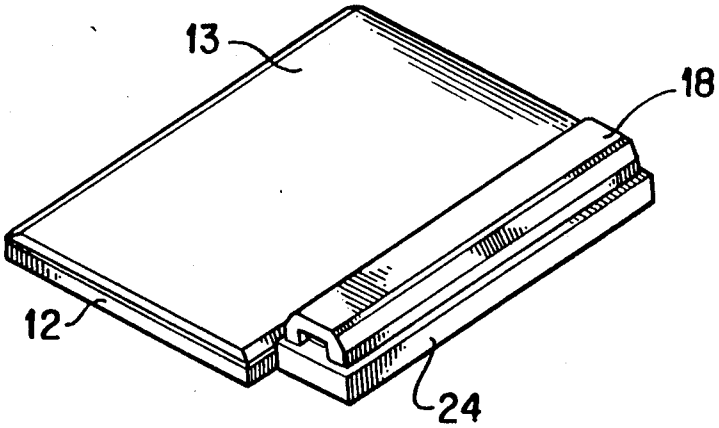
FIG. 4 is a perspective view of a printhead and maintenance station according to the present invention in a printhead capping position.

FIG. 4 is a perspective view of maintenance station 24 in a capping position over printhead 18. Platen 12 contains a sheet 13 thereon, and is located at the sheet receiving position. FIG. 5 shows maintenance station 24 spaced away from printhead 18, while printhead 18 performs a printing operation on sheet 13 with platen 12 located in print zone C.

Figure 6A:
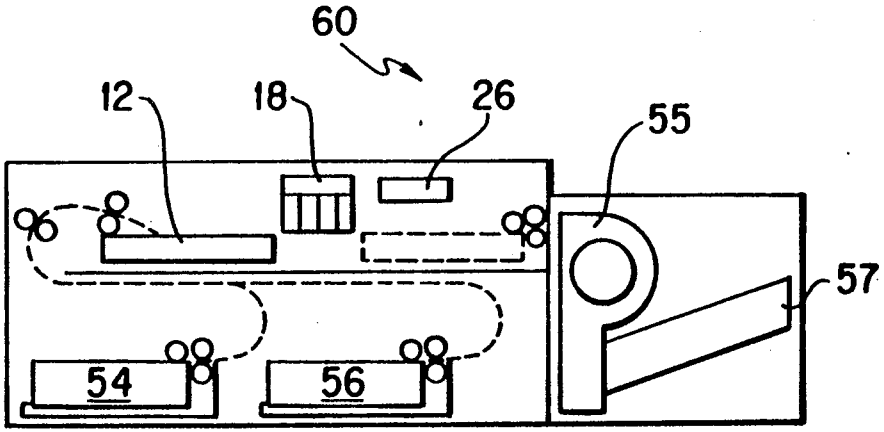
FIGS. 6A–6C are schematic side views of ink jet printers employing the architecture of the present invention, and showing some of the components thereof.
Figure 6B:
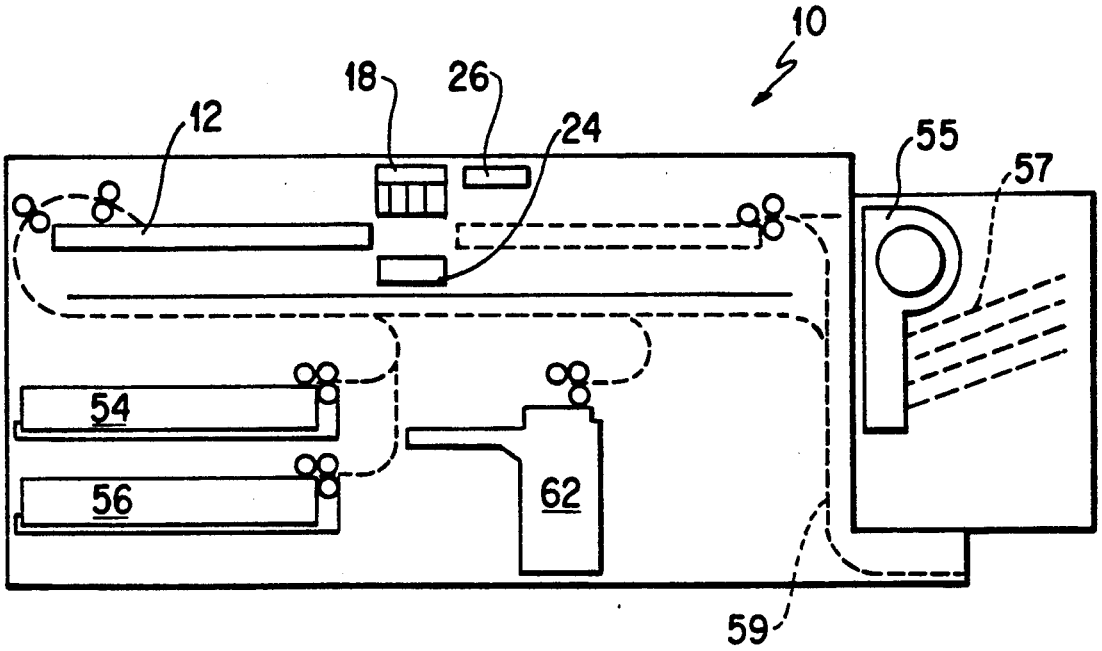
Figure 6C:
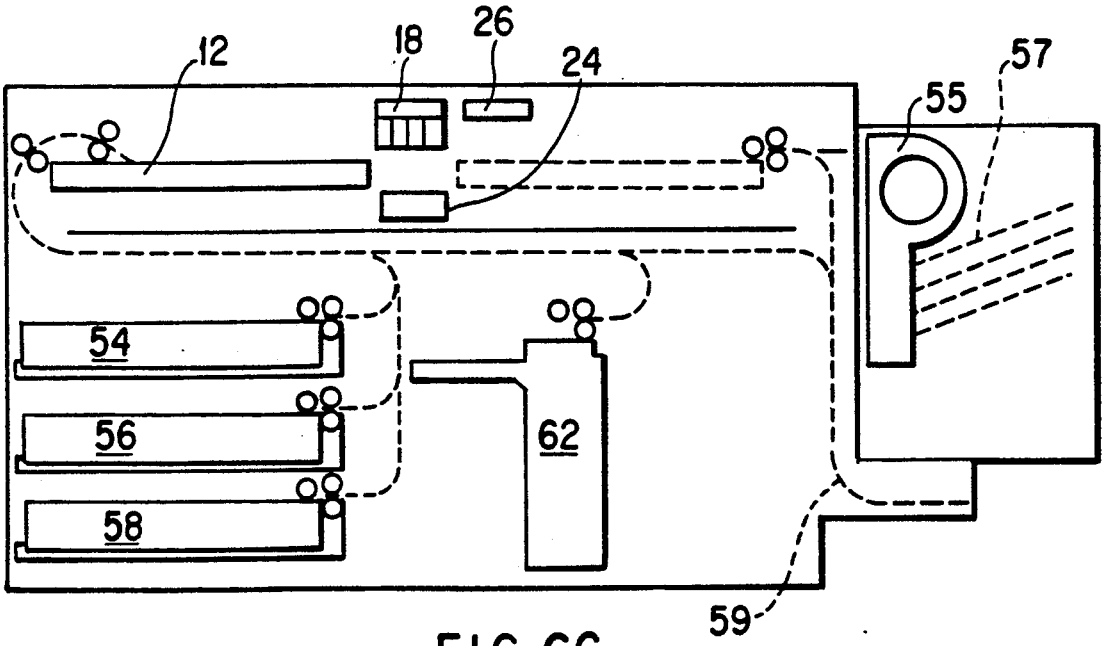

Optionally, a drying station 26 may be added downstream of the print zone C. Any conventional type of dryer appropriate for drying ink deposited on a recording medium can be used in the present invention. Some examples of dryers include warm dry air blowers and radiant heaters using lamps or quartz rods as heat sources. The dryer 26 can be located between printhead 18 and sheet releasing position B as shown in FIG. 1, over platen 12 when platen 12 is located at the sheet releasing position as shown in FIGS. 6A–6C, or downstream of sheet releasing position B. Additionally, the plate (or plates) which form the sheet receiving surface 22 of platen 12 can be heated to provide a drying effect on a sheet of paper located thereon.

Figure 2:
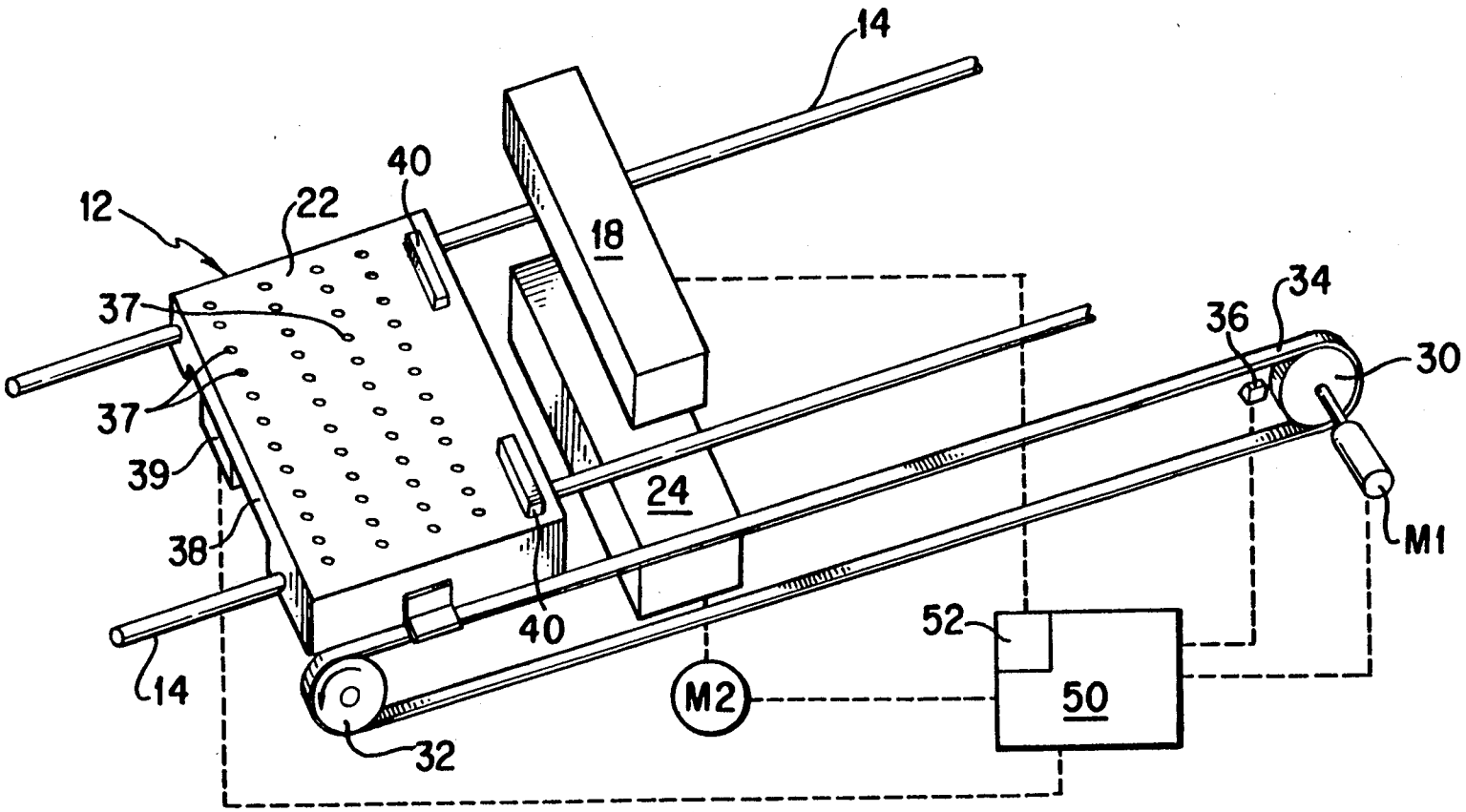
FIG. 2 is a perspective view of the upper surface of a platen which uses a vacuum hold-down force to maintain a sheet flat thereon, and also shows the driving mechanisms for linearly reciprocally moving the platen, for moving the maintenance station, as well as a controller for controlling the drive mechanisms.

FIG. 2 is a perspective view of a portion of a printer showing the upper surface 22 of platen 12, a printhead 18, a maintenance station 24, a mechanism for moving platen 12 along a linear reciprocal path, and a controller 50 for controlling printhead 18 and the motions and operations of platen 12 and maintenance station 24. FIG. 2 illustrates the manner in which a vacuum hold-down force can be used to hold a sheet flat on the sheet receiving surface 22 of platen 12. Specifically, sheet receiving surface 22 can include a plurality of apertures 37 therein through which a vacuum can be applied. A blower 39 can be attached to a plenum chamber 38 of platen 12, so as to pull air through apertures 37, thus holding a sheet flat on platen 12. The use of vacuum to hold sheets flat on a surface is well known in the art of paper handling, an thus no further discussion is warranted. Of course, other means for holding a sheet flat on a surface, such as, for example, electrostatic force or sheet grippers, can also be used.

In order to align a sheet of recording medium (e.g., paper) on sheet receiving surface 22, movable sheet stops 40 can be provided in platen 12. When a sheet is moved into contact with sheet stops 40, the leading edge of the sheet will be aligned perpendicular to the motion path of platen 12. Sheet stops 40 can be movable through surface 22 of platen 12 so that they will contact and align a sheet when extending through surface 22, or allow a sheet to be conveyed away from platen 12 (to the right in FIG. 2) when located below surface 22 (within platen 12). For example, sheet stops 40 can be spring biased toward the position shown in FIG. 2 where they will stop a sheet. Upon movement of platen 12 to sheet releasing position B, a cam surface (not shown) located above platen 12 (in the vicinity of output roller 25 of FIG. 1) could contact sheet stops 40 to move sheet stops 40 below surface 22, thus permitting a sheet to be removed from platen 12. The position of sheet stops could also be controlled by controller 50 which could activate solenoids for moving sheet stops 40 below surface 22 at the appropriate time. The use of sheet stops, as well as chutes, gates and other paper handling and aligning mechanisms for guiding and aligning sheets will be apparent to one of ordinary skill in the paper handling art.

FIG. 2 also shows one type of mechanism capable of linearly reciprocating platen 12 between the sheet receiving position and the sheet releasing position. A pair of parallel guide bars 14 are provided, to which opposite ends of platen 12 are movably attached. As shown in FIG. 1, platen 12 can include rollers or bearings 16 in contact with guide bars 14 for providing smooth movement of platen 12 along guide bars 14. Platen 12 is attached to endless belt 34 which reciprocates platen 12 along guide bars 14. Belt 34 is wrapped around a drive pulley 30 and a spring biased follower pulley 32. Follower pulley 32 is biased to rotate in the counterclockwise direction so as to return platen 12 to the sheet receiving position A. A stop (not shown) can be provided for stopping the leftward movement of platen 12. A motor M1 rotates drive pulley 30 in the clockwise direction under the control of controller 50 so as to smoothly move platen 12 from the sheet receiving position A to the sheet releasing position B. When power is cut from motor M1, platen will "flyback" to the sheet receiving position A due to the spring bias of pulley 32.

As an alternative means for reciprocating the platen 12, motor M1 can be a stepper motor. The stepper motor provides precise positioning of platen 12 through counted steps provided by controller 50.

An encoder or tachometer 36 can be provided for monitoring the rotary speed of motor M1, (and thus the linear speed of platen 12). The information retrieved by encoder 36 can be used in a conventional manner by controller 50 to provide for accurate image formation by printhead 18 on a sheet held by platen 12. For example, if motor M1 is a servo motor, controller 50 can precisely monitor and control the rotation of motor M1. Alternatively, any variations in the speed of motor M1 detected by encoder 36 can be used by the image driver 52 of controller 50 to appropriately vary the frequency of the video signal provided to printhead 18. Both of the above described closed loop feedback control processes are well known in the ink jet printer art.

Controller 50 also controls a second drive motor M2, used to selectively move maintenance station 24 toward and away from printhead 18. Controller 50 can also control the mechanism that applies the hold-down force to a sheet on platen 12. For example, controller could activate and deactivate the vacuum or electrostatic force generators. The vacuum or electrostatic forces could also be continuously generated as long as this would not affect the alignment and removal of sheets on the platen.

The disclosed apparatus may be readily operated and controlled with conventional control systems. Some additional examples of control systems for various prior art imaging devices with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable to program and execute such control functions and logic with conventional software instructions for conventional microprocessors. This is taught by the above and other patents and various commercial imaging devices. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

Figure 3:
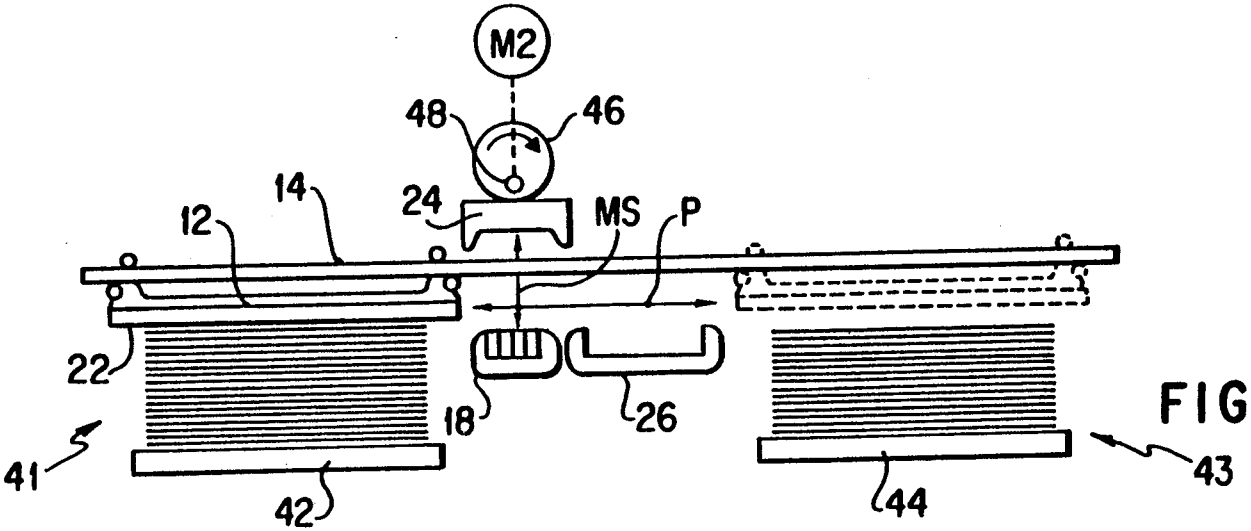
FIG. 3 is a side view of an ink jet printer according to a second embodiment of the present invention.

With reference to FIG. 3, there is shown another embodiment of an ink jet printer having a platen 12 which is linearly reciprocal along a plane P from a sheet receiving position to a sheet releasing position (where the platen is shown by dashed line). As in FIGS. 1 and 2, the platen 12 is movably supported for linear reciprocal movement by guide rods 14. A full width printhead 18 is located between a sheet receiving position and a sheet releasing position on a side of plane P. In the FIG. 3 example, the printhead 18 is located below plane P and expels droplets in an upward direction.

In operation, the platen 12 is initially located at the sheet receiving position, directly above a supply elevator 41 which contains a stack of blank sheets on supply pallet 42. The supply elevator 41 is vertically movable so that a top sheet of paper in the stack is positioned an appropriate distance below the platen 12 as shown in FIG. 3. The location of the top sheet on supply pallet 42 can be monitored using sensors as is conventional. For example, if the top of the supply stack falls below the sensor, pallet 42 will be activated to move upwardly until the top of stack is again sensed. A holddown force, which as previously described may be a vacuum or an electrostatic force, is applied to acquire the top sheet of the supply stack onto the planar sheet receiving surface 22 of the platen 12. Surface 22 of platen 12 can include sheet guides for guiding a sheet to a predetermined position thereon.

Once a sheet is acquired onto the surface 22 of platen 12, the platen can be controlled to linearly travel along guide rods 14 along plane P toward the sheet releasing position, and above printhead 18. As the platen 12 is moved, it conveys the sheet held thereon past the printhead 18 which prints an image onto the sheet. The platen 12 continues to move the sheet having an image thereon along plane P until the platen and sheet reach the sheet releasing position. When the platen 12 has traveled into the sheet releasing position, the holddown force is released and the sheet falls from platen 12. A receiving elevator 43 having receiving pallet 44 is located directly below platen 12 at the sheet releasing position. Thus, printed sheets fall by gravity from the surface 22 of platen 12 onto the receiving pallet 44 to form an output stack. Guide means may be provided for ensuring alignment of the falling sheets into the receiving elevator.

As in the previous embodiment, a maintenance station 24 and a drying station 26 may be provided. These function as previously described, and are located as shown in FIG. 3 with the maintenance station 24 being on a side of platen 12 opposite to printhead 18 and substantially in opposition thereto.

FIG. 3 also illustrates one means for moving maintenance station 24 along line MS into and out of engagement with printhead 18. For example, maintenance station 24 can be spring biased away from printhead 18 toward the position shown in FIG. 3. A cam 46 is provided and rotated by motor M2 attached to shaft 48. As shaft 48 is rotated 180° from the FIG. 3 position by motor M2, cam 48 pushes maintenance station 24 against the spring bias and into engagement with printhead 18. Of course, the printhead could be moved toward the maintenance station, or both the maintenance station and printhead could move. Other mechanisms for moving maintenance station 24 and/or printhead 18 along line MS can also be provided.

Use of the second embodiment provides numerous advantages. Primarily, the use of this embodiment eliminates conventional paper paths, greatly reducing the complexity of sheet movement from supply to output. With fewer components and less complicated paper paths, the system is capable of providing quality imaging with more reliability, fewer jams, and less maintenance. Additionally, the completely linear paper path reduces wrinkling and increases sheet flatness both during printing and at ultimate sheet finishing.

FIGS. 6A–6C are schematic side views of ink jet printers constructed using the reciprocating flat platen architecture of FIGS. 1 and 2. Each printer includes a platen 12 and a four color ink jet printhead 18, as well as a disc stacker 55 having an output tray 57. Note that the dryer 26 is arranged over platen 12 when the platen is located at the sheet releasing position. This permits the construction of a more compact printer. Also note that the desk-top printer 60 of FIG. 6A does not include a maintenance station, although a maintenance station 24 is preferably provided therein.

The desk-top model 60 of FIG. 6A includes two sheet supply trays 54, 56 for supplying different sized sheets to platen 12. The larger printers of FIGS. 6B and 6C each include a high-capacity sheet supply bin 62 capable of holding, for example, 1000 sheets. The printer of FIG. 6C also includes a third sheet supply tray 58. The larger printers of FIGS. 6B and 6C also include sheet inverter paths 59 to enable duplex printing to be performed. A sheet inverter, such as disclosed in any of U.S. Pat. Nos. 4,918,490 to Stemmle, 4,935,786 to Veeder, 4,934,681 to Holmes et al, or 4,453,841 to Bobick et al, the disclosures of which are incorporated herein by reference, could be used to invert sheets for duplex printing. The flow of sheets through the FIGS.

6A-6C printers could be controlled in a conventional manner, well known in the sheet handling art.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An ink jet printer comprising:

a platen having a constantly planar surface sized to hold a sheet upon which an image is to be printed flat on said planar surface, said platen being movably mounted for linear reciprocal movement in a direction between a sheet receiving position and a sheet releasing position;

means for supplying sheets to said platen at said sheet receiving position;

means for receiving sheets from said platen at said sheet receiving position;

a full width ink jet printhead, extending in a direction substantially perpendicular to the direction of linear reciprocal movement of said platen, said full width printhead being fixedly mounted between said sheet receiving position and said sheet releasing position; and means for reciprocally moving said platen along a line of said linear movement between said sheet receiving position and said sheet releasing position, said platen being reciprocated in a single plane between said sheet receiving position and said sheet releasing position.

2. The printer of claim 1, further comprising:

means for holding a sheet flat on said planar surface of said platen.

3. The printer of claim 2, wherein said means for holding includes means for applying a vacuum to the sheet on said platen to hold the sheet on said planar surface of said platen.

4. The printer of claim 1, wherein said means for moving includes a pair of guides extending in said direction of linear reciprocal movement of said platen, said platen having opposite ends which are movably mounted to a corresponding one of said pair of guides.

5. The printer of claim 4, wherein said pair of guides are a pair of guide bars.

6. The printer of claim 1, wherein said platen includes a flat plate defining a sheet receiving surface of said platen.

7. The printer of claim 1, wherein said means for supplying sheets includes a supply elevator having a flat supply pallet which is vertically movable, capable of holding a stack of blank sheets, and located at said sheet receiving position.

8. The printer of claim 7, wherein said means for receiving sheets includes a receiving elevator having a flat receiving pallet which is vertically movable, capable of holding a stack of printed sheets, and located at said sheet releasing position.

9. The printer of claim 1, further comprising a maintenance station located between said sheet receiving position and said sheet releasing position on an opposite side of said platen from said full width printhead, said maintenance station extending parallel to, and being movably engageable with said full width ink jet printhead.

10. The printer of claim 1, wherein said means for supplying sheets includes a roller pair.

11. The printer of claim 1, wherein said printhead is located above said platen and fires ink downward onto said sheet held on said platen, said platen being movably mounted for reciprocal travel in a horizontal plane.

12. An ink jet printer comprising:

a platen having a constantly planar surface sized to hold a sheet upon which an image is to be printed flat on said planar surface, said platen being movably mounted for linear reciprocal movement in a direction between a sheet receiving position and a sheet releasing position;

means for supplying sheets to said platen at said sheet receiving position;

means for receiving sheets from said platen at said sheet releasing position;

a pagewidth ink jet printhead, extending in a direction substantially perpendicular to the direction of linear reciprocal movement of said platen, said pagewidth printhead being fixedly mounted between said sheet receiving position and said sheet releasing position;

means for reciprocally moving said platen along a line of said linear movement between said sheet receiving position and said sheet releasing position, said platen being reciprocated in a single plane between said sheet receiving position and said sheet releasing position; and a maintenance station located between said sheet receiving position and said sheet releasing position on an opposite side of said platen from said pagewidth printhead, said maintenance station extending parallel to said pagewidth printhead and being located on said opposite side of said platen so as to be in opposition to said printhead.

13. The printer of claim 12, wherein said maintenance station is operable in a purge mode when said platen is located at either said sheet receiving position or said sheet releasing position, said maintenance station receiving ink expelled from nozzles of said pagewidth printhead when in said purge mode.

14. The printer of claim 13, wherein said maintenance station is movably engageable with said pagewidth printhead, said printer further comprising:

means for selectively moving said maintenance station toward and away from said pagewidth printhead.

15. The printer of claim 12, further comprising:

means for holding a sheet flat on said planar surface of said platen.

16. The printer of claim 15, wherein said means for holding includes means for applying a vacuum to the sheet on said platen to hold the sheet on said planar surface of said platen.

17. An ink jet printer comprising:

a platen including a flat plate which defines a constantly planar sheet receiving surface sized to hold a sheet upon which an image is to be printed flat thereon, said platen being movably mounted for linear reciprocal movement in a direction between a sheet receiving position and a sheet releasing position;

a sheet supply for supplying said platen with sheets when said platen is located at said sheet receiving position;

a sheet receiver for receiving sheets from said platen at said sheet releasing position;

a pagewidth ink jet printhead, extending in a direction substantially perpendicular to the direction of linear reciprocal movement of said platen, said pagewidth printhead being mounted between said sheet receiving position and said sheet releasing position;

at least one guide extending in said direction of linear reciprocal platen movement, said platen being movably mounted to said at least one guide; and a drive mechanism attached to said platen for reciprocally moving said platen along said at least one guide along a line of said linear movement between said sheet receiving position and said sheet releasing position, said platen being reciprocated in a single plane between said sheet receiving position and said sheet releasing position.

18. The printer of claim 17, wherein said pagewidth printhead is stationarily mounted in said printer between said sheet receiving position and said sheet releasing position at a side of a plane through which said platen reciprocates and opposed to said flat plate.

19. The printer of claim 18, further comprising:

a maintenance station located between said sheet receiving position and said sheet releasing position on an opposite side of said platen from said pagewidth printhead, said maintenance station extending parallel to said pagewidth printhead and being located on said opposite side of said platen so as to be in opposition to said printhead.

20. The printer of claim 19, wherein said maintenance station is movably engageable with said pagewidth printhead, said printer further comprising:

means for selectively moving said maintenance station toward and away from said pagewidth printhead.

21. The printer of claim 17, wherein said at least one guide is a pair of guide bars extending in said direction of reciprocal platen movement, said platen having opposite ends movably mounted to a corresponding one of said pair of guide bars.

22. The printer of claim 17, further comprising:

means for holding a sheet flat on said flat plate of said platen.

23. The printer of claim 22, wherein said means for holding includes means for applying a vacuum to the sheet on said platen to hold the sheet on said flat plate of said platen.

24. The printer of claim 17, wherein said sheet supply includes a supply elevator having a flat supply pallet which is vertically movable, capable of holding blank sheets, and located at said sheet receiving position.

25. The printer of claim 17, wherein said sheet receiver includes a receiving elevator having a flat receiving pallet which is vertically movable, capable of holding a stack of printed sheets, and located at said sheet releasing position.

* * * * *